United States Patent [19]

Wang

[11] Patent Number: 5,071,378

[45] Date of Patent: Dec. 10, 1991

[54] BOAT IMPELLER WHEEL FOR MINIMIZING THE SPLASHES THEREFROM

[76] Inventor: Cheng-Chung Wang, 12th Fl., No. 440, Sec. 4, Jen-Ai Rd., Taipei, Taiwan

[21] Appl. No.: 577,066

[22] Filed: Sep. 4, 1990

Related U.S. Application Data

[63] Continuation of Ser. No. 232,993, Aug. 17, 1988, abandoned.

[51] Int. Cl.[5] ..... B63H 1/04

[52] U.S. Cl. ..... 440/90; 416/117

[58] Field of Search ..... 440/13, 17, 19, 21, 440/26-31, 90-93; 416/98, 117 R, 17, 14, 107, 139, 140, 167

[56] References Cited

U.S. PATENT DOCUMENTS

| | | | |
|---|---|---|---|
| 67,437 | 8/1867 | Keene | 416/117 |
| 398,703 | 2/1889 | Collins | 440/27 |
| 2,099,617 | 11/1937 | Nelson | 416/117 |
| 3,111,110 | 11/1963 | Putten | 440/13 |

FOREIGN PATENT DOCUMENTS

| | | | |
|---|---|---|---|
| 3303532 | 8/1984 | Fed. Rep. of Germany | 416/117 |

*Primary Examiner*—Jesus D. Sotelo

*Attorney, Agent, or Firm*—Nixon & Vanderhye

[57] ABSTRACT

A boat impeller wheel includes a rotating shaft, and a plurality of supporting rods extending radially from the rotating shaft. An impeller vane is mounted rotatably on each of the supporting rods. When any one of the impeller vanes leaves water's surface, it can rotate about the corresponding supporting rod to a position appropriate for minimizing the splashes from the impeller vanes.

11 Claims, 5 Drawing Sheets

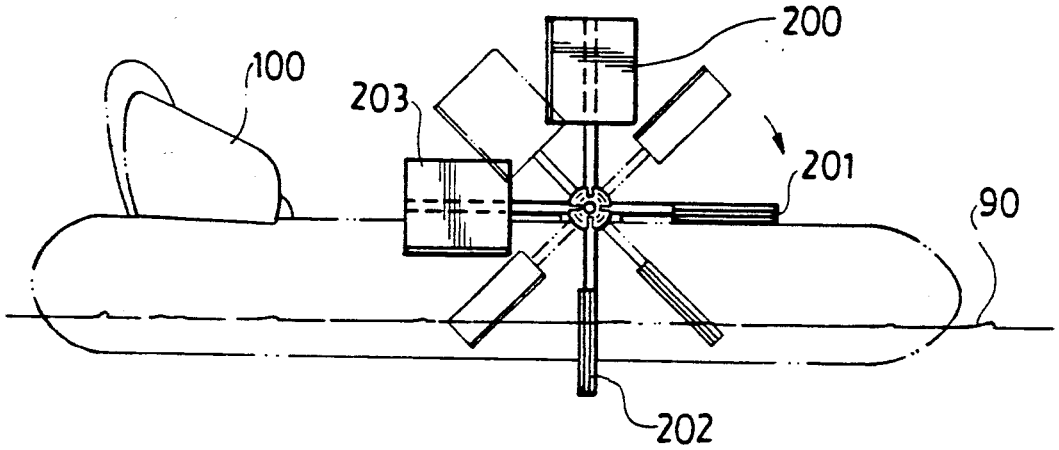
FIG. 3
FIG. 4
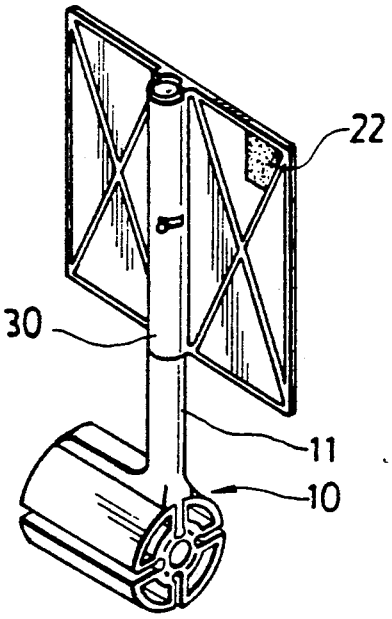
FIG. 5
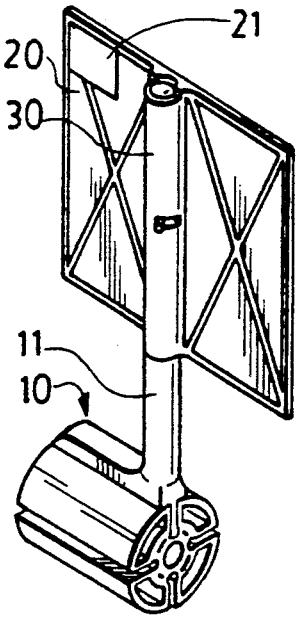

BOAT IMPELLER WHEEL FOR MINIMIZING THE SPLASHES THEREFROM

This is a continuation of application Ser. No. 07/232,993, filed Aug. 17, 1988, now abandoned.

BACKGROUND OF THE INVENTION

This invention relates to a boat impeller wheel which can minimize the splashes therefrom when propelling a boat without the necessity of providing a splashboard.

While propelling a boat with an impeller wheel, water splashes from the radial end edges of the impeller vanes when the impeller vanes of the impeller wheel leave the water's surface Additionally, water, dropping from a conventional impeller vane which is in an obliquely upward position in relation to the water's surface, will suffer the impact of the impeller vane which is just rising from the water's surface, thereby resulting in splashes. Thus, a splashboard is usually provided on the boat around the impeller wheel for splash protection.

When an inflatable raft is designed so that it has an impeller wheel which can be driven by foot, a splashboard must be provided on the raft around the impeller wheel. The provision of the impeller wheel on the inflatable raft incurs the disadvantages of increased manufacturing costs, difficult assembly, decreased portability and a more unsightly outer appearance.

SUMMARY OF THE INVENTION

It is therefore the main object of this invention to provide a boat impeller wheel which can minimize the splashes therefrom without the necessity of providing a splashboard.

According to one aspect of this invention, a boat impeller wheel includes a rotating shaft, and a plurality of impeller vane units. Each of the impeller vane units includes a cylindrical supporting rod extending radially from the rotating shaft, a planar impeller vane having a circular and tubular middle portion which is sleeved rotatably on the supporting rod in such a manner that the center of gravity of the impeller vane is not on the axis of the supporting rod, and means for limiting the impeller vane to rotate about the supporting rod between a first position and a second position. The impeller vane is almost parallel to the rotating shaft at the first position and generally perpendicular to the rotating shaft at the second position so that it can rotate an angle of slightly less than 90 degrees about the supporting rod. When any one of the impeller vanes is turned downward from a substantially forward position to a substantially downward position about said rotating shaft, it is almost parallel to water's surface. When any one of the impeller vanes is turned upward away from the water's surface, it rotates rapidly about the supporting rod until it is generally perpendicular to the water's surface.

According to another aspect of this invention, a boat impeller wheel includes a rotating shaft, and a plurality of impeller vane units. Each of the impeller vane units includes a supporting rod extending radially from the rotating shaft, a planar main plate secured to the supporting rod at an intermediate portion thereof in parallel with the rotating shaft and having a leading surface and a trailing surface, and a planar swing plate connected pivotally to the radial outer end of the trailing surface of the main plate at the radial outer end portion thereof and rotatable about an axis generally perpendicular to the supporting rod. When any one of the impeller vane units is turned downward from a substantially upward position to a substantially downward position about the rotating shaft, the radial inner end of the adjacent swing plate engages with the trailing surface of the main plate. When any one of the impeller vane units is turned upward away from water's surface, the radial inner end of the adjacent swing plate is remote from the main plate. Each of the main plates has a cut-away portion opposite the major part of the corresponding swing plate so that the water thrown away from the main plate is minimized.

BRIEF DESCRIPTION OF THE DRAWINGS

Other features and advantages of this invention will become apparent in the following detailed description of the preferred embodiments of this invention with reference to the accompanying drawings in which:

FIG. 3 is a schematic view illustrating the operation of the boat impeller wheel according to the first embodiment of this invention;

FIG. 4 is a perspective view illustrating the structure of a boat impeller wheel according to a second embodiment of this invention;

FIG. 5 is a perspective view illustrating the structure of a boat impeller wheel according to a third embodiment of this invention;

DETAILED DESCRIPTION OF THE PREFERRED EMBODIMENTS

Figure 2:
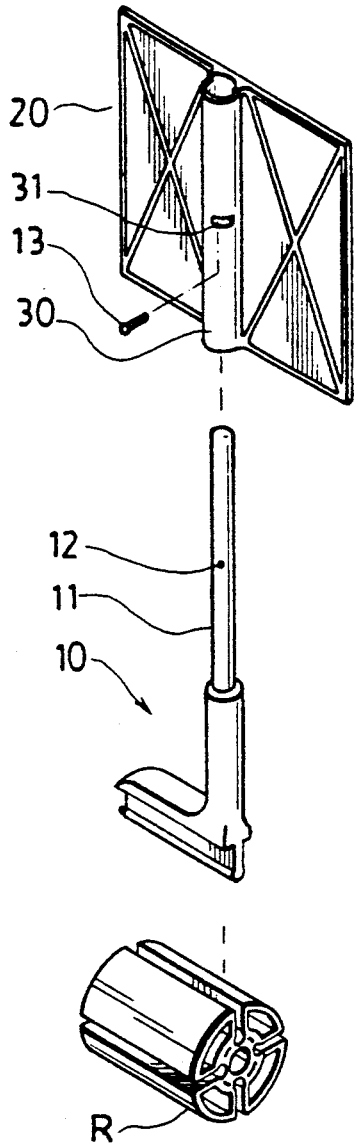
FIG. 2 is an exploded view illustrating the structure of the boat impeller wheel according to the first embodiment of this invention.
Figure 1:
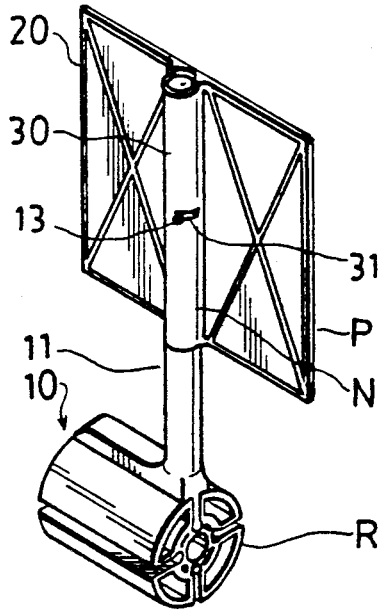
FIG. 1 is a perspective view illustrating the structure of a boat impeller wheel according to a first embodiment of this invention.

The boat impeller wheel of this invention includes a rotating shaft, and a plurality of impeller vane units mounted on the rotating shaft. Referring to FIGS. 1 and 2, the assembly of the rotating shaft R and one impeller vane unit 10 is shown. The impeller vane unit 10 includes a supporting rod 11 extending radially from the rotating shaft R, and a planar rectangular impeller vane 20 mounted rotatably on the supporting rod 11. As illustrated, the supporting rod 11 is mounted removably on the rotating shaft R by a dovetail joint. The impeller vane 20 has a circular and tubular middle portion 30 which is sleeved rotatably on the diameter-reduced cylindrical portion of the supporting rod 11. The impeller vane 20 is divided by the tubular middle portion 30 into two similar side portions both of which are tangent to the tubular middle portion 30. The impeller vane 20 therefore has a planar surface P and a non-planar or ragged surface N. Thus, the center of gravity of the impeller vane 20 is not on the axis of the supporting rod 11. The tubular middle portion 30 has a circumferentially extending slide slot 31 through which a bolt 13 extends to engage threadably with the threaded hole 12 of the supporting rod 11. The ends of the slide slot 31 are angularly spaced at an angle of 85 degrees so that the impeller vane 20 can rotate 85 degrees about the supporting rod 11. When the bolt 13 is at one end of the slide slot 31, the impeller vane 20 is almost parallel to the rotating shaft R so as to propel the boat. When the bolt 13 is at the other end of the slide slot 31, the impeller vane 20 is generally perpendicular to the rotating shaft R so as to move vertically and upwardly away from the water's surface, thereby minimizing the splashes therefrom.

Referring to FIG. 3., the impeller vane unit 10 is rotated clockwise about the rotating shaft R so as to propel a raft 100 to the right. When the impeller vane unit 10 is in its substantially forward position 201, the impeller vane 20 is at an angle of 5 degrees to the water's surface 90 and the planar surface P of the impeller vane 20 faces downward due to the fact that the center of gravity of the impeller vane 20 is in the area of its tubular middle portion. During the rotation of the impeller vane 20 from its substantially forward position 201 to its substantially downward position 202, because the action of the gravity of the impeller vane 20 is greater than the action of water resistance, the impeller vane 20 is still almost parallel to the rotating shaft R. When the impeller vane 20 is turned from its substantially downward position 202 to its substantially rearward position 203, it rotates slowly about the supporting rod 11 because the impeller vane 20 is at an angle of 5 degrees to the rotating shaft R when it is in its substantially downward position 202 and because the action of water resistance is greater than the action of the gravity of the impeller vane 20. As soon as part of the impeller vane 20 leaves the water's surface 90, because wind resistance is substantially less than water resistance and the impeller vane 20 is inclined relative to the water's surface 90, the impeller vane 20 rotates rapidly about the supporting rod 11 until it is generally perpendicular to both the water's surface 90 and the rotating shaft R. It should be appreciated that water will be thrown rearward and to the outside of the raft 100, away from the upright impeller vane 20, which is just leaving the water's surface 90. Accordingly, splashes from the impeller vane 20 are minimized.

Referring to FIG. 4, to accelerate the rotation of the impeller vane 20 about the supporting rod 11, a counterweight 22 may be attached to one side portion of the impeller vane 20. Alternatively, referring to FIG. 5, a buoyant element 21 may be substituted in place of counterweight 22.

Figure 6:
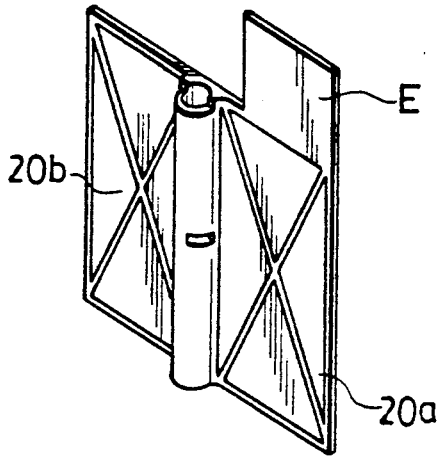
FIG. 6 is a perspective view illustrating the structure of a boat impeller wheel according to a fourth embodiment of this invention.
Figure 7:
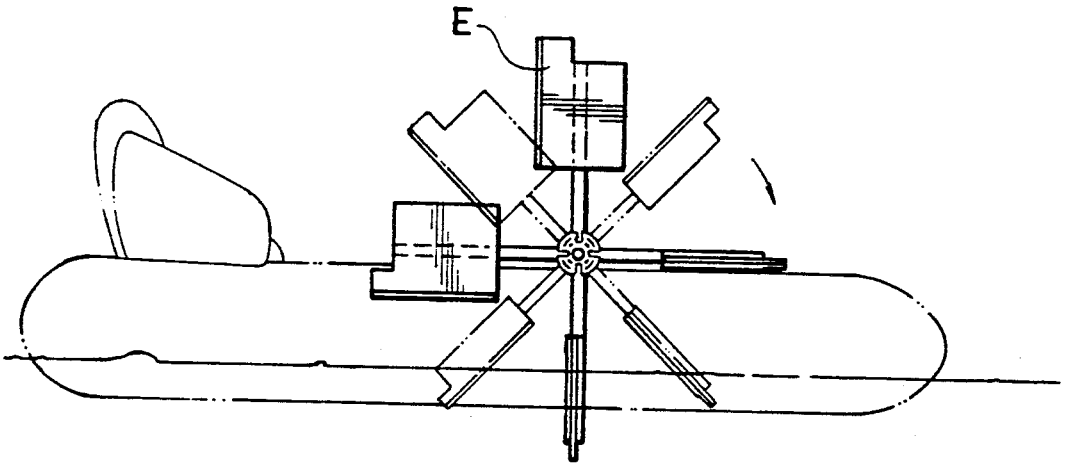
FIG. 7 is a schematic view illustrating the operation of the boat impeller wheel according to the fourth embodiment of this invention.

Referring to FIG. 6, the side portion 20*a* of the impeller vane near the slide slot may be formed with an extension portion E at the radial outer end. Because the water resistance to the side portion 20*a* is greater than that to the other side portion 20*b*, the rotational speed of the impeller vane about the supporting rod is increased. Referring to FIG. 7, after the side portion 20*a* of the impeller vane is turned upward away from the water surface, it can also rotate rapidly about the supporting rod to a generally vertical position.

Figure 9:
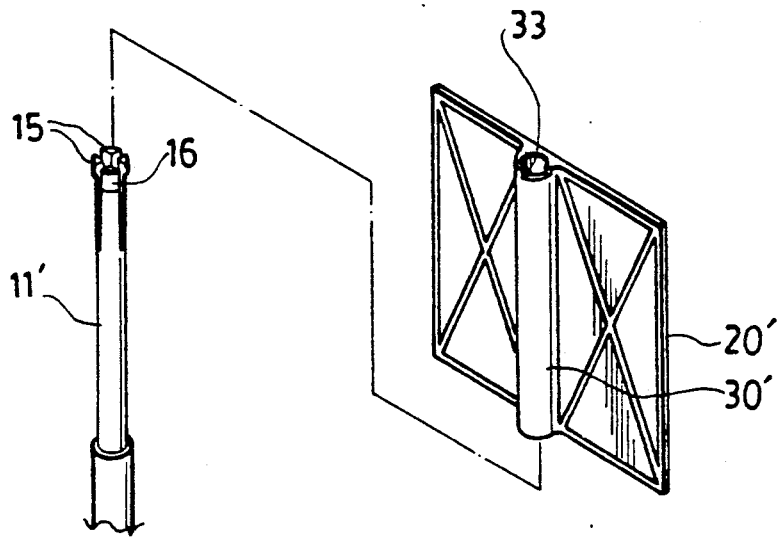
FIG. 9 is an exploded view illustrating the structure of the boat impeller wheel according to the fifth embodiment of this invention.
Figure 10:
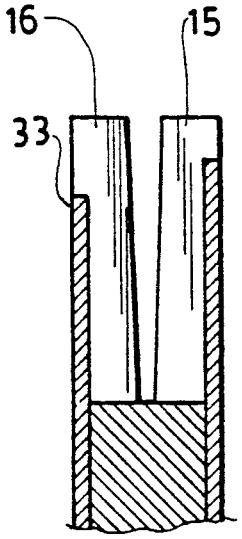
FIG. 10 is a sectional view illustrating the structure of the boat impeller wheel according to the fifth embodiment of this invention.
Figure 8:
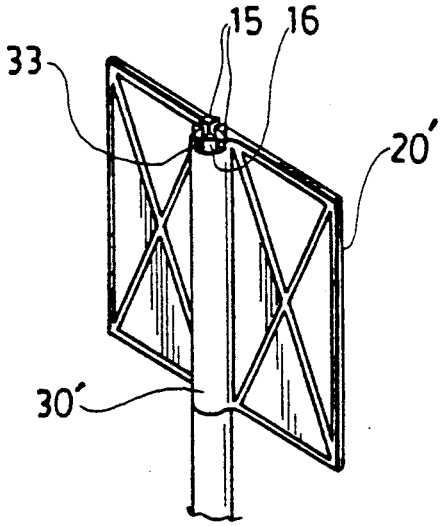
FIG. 8 is a perspective view illustrating the structure of a boat impeller wheel according to a fifth embodiment of this invention.

Referring to FIGS. 8–10, instead of the assembly of the slide slot 31, the threaded hole 12 and the bolt 13 of the impeller vane unit 10, a slide groove 33 may be formed in the radial outer end surface of the tubular middle portion 30' of an impeller vane 20' and a large protrusion 16 may project radially from the outer end of a supporting rod 11'. The large protrusion 16 is received slidably in the slide groove 33. The outer end of the supporting rod 11' also has three separate small protrusions 15 projecting radially therefrom for preventing the impeller vane 20' from moving out of the supporting rod 11'. The protrusions 15 and 16 are respectively formed on four spaced-apart arms of the supporting rod 11' which can be pushed radially inwardly so as to be inserted through the tubular middle portion 30' of the impeller vane 20' when joining both the supporting rod 11' and the impeller vane 20' together.

Figure 11:
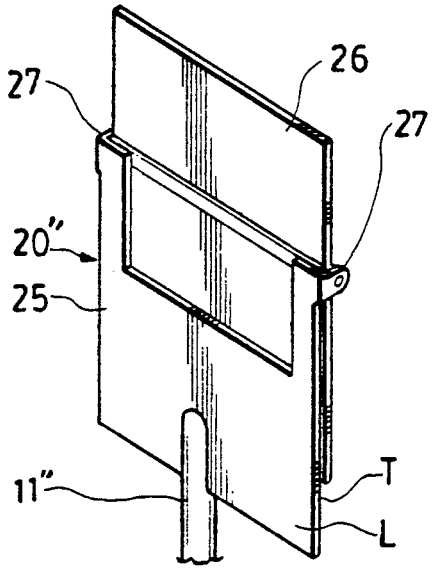
FIG. 11 is a perspective view illustrating the structure of a boat impeller wheel according to a sixth embodiment of this invention.
Figure 12:
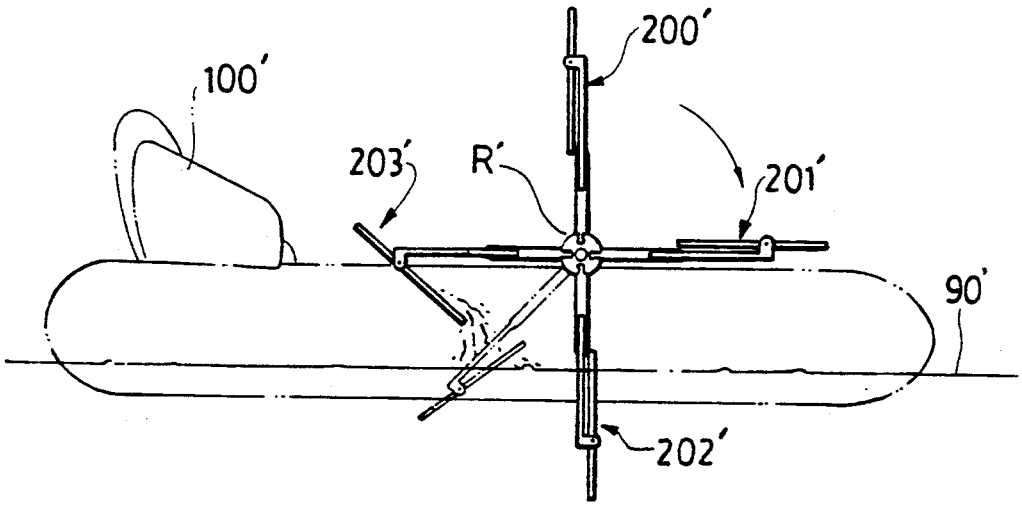
FIG. 12 is a schematic view illustrating the operation of the boat impeller wheel according to the sixth embodiment of this invention.

Referring to FIGS. 11 and 12, another boat impeller wheel of this invention includes a rotating shaft R', and a plurality of impeller vane units 20'. Each of the impeller vane units 20'' includes a supporting rod 11'' extending radially from the rotating shaft R' and a planar rectangular main plate 25 secured to the supporting rod 11'' at an intermediate portion thereof in parallel with the rotating shaft R'. The main plate 25 has a leading surface L and a trailing surface T and includes two lugs 27 respectively projecting from opposite sides of the radial outer end of the trailing surface T thereof. A planar rectangular swing plate 26 is mounted pivotally on the lugs 27 at the radial outer end portion thereof. The impeller vane unit 20'' is also rotated clockwise about the rotating shaft R' so as to propel a boat 100' to the right. When the impeller vane unit 20'' is turned downward from its substantially upward position 200' to its substantially forward position 201', the radial. inner end of the swing plate 26 engages with the trailing surface T of the main plate 25 due to the force of gravity. During the rotation of the impeller vane unit 20'' from its substantially forward position 201' to its substantially downward position 202', because water resistance is created to the radial outer end portion of the swing plate 26, the inner end of the swing plate 26 still engages with the trailing surface T of the main plate 25. When the impeller vane unit 20'' rotates from its substantially downward position 202' to its substantially rearward position 203', because the action of water resistance is greater than the action of the gravity of the swing plate 26, the radial inner end of the swing plate 26 separates gradually from the trailing surface T of the main plate 25. As soon as the impeller vane unit 20'' leaves the water's surface 90', a portion of the water on the impeller vane unit 20'' flows back to the water's surface 90' along the swing plate 203'. Splashes from the impeller vane unit 20'' are therefore reduced. The main plate 25 has a rectangular cut-away portion 25*a* opposite the major part of the swing plate 26. Because the swing plate 26 is rotatable, there is a very little amount of water thrown therefrom. The area of the main plate 25 is reduced so that the amount of water thrown therefrom is also reduced.

With this invention thus explained, it is apparent that numerous modifications and variations can be made without departing from the scope and spirit of this invention. It is therefore intended that this invention be limited only as indicated in the appended claims.

I claim:

1. A boat impeller wheel comprising:

a rotating shaft, and a plurality of impeller vane units, each said impeller vane unit including a cylindrical supporting rod having an axis and extending radially from said rotating shaft, a planar impeller vane having a circular and tubular middle portion which is sleeved rotatably on said supporting rod, and limiting means for limiting said impeller vane to rotate about said supporting rod between a first position and a second position, said limiting means including a slide groove formed in an outer end surface of said tubular middle portion of each of said impeller vanes and a protrusion projecting radially from an outer end of said corresponding supporting rod and received slidably in said slide groove of said impeller vane, said impeller vane being almost parallel to said rotating shaft at said first position and generally perpendicular to said rotating shaft at said second position so that it can rotate about said supporting rod at an angle of no greater than 90°, any one of said impeller vanes when in a substantially forward position and turned downwardly towards the water surface being almost parallel to said water surface, and any one of said impeller vanes when turned upward away from said water surface rotating rapidly about said supporting rod until it is generally perpendicular to said water surface.

2. A boat impeller wheel as claimed in claim 1, wherein each of said impeller vanes includes a counterweight attached to a portion thereof other than said tubular middle portion so as to accelerate rotation of said impeller vane about said supporting rod.

3. A boat impeller wheel as claimed in claim 1, wherein each of said impeller vanes includes a buoyant element attached to a portion thereof other than said tubular middle portion so as to accelerate rotation of said impeller vane about said supporting rod.

4. A boat impeller wheel as claimed in claim 1, wherein each of said impeller vanes is divided by said tubular middle portion thereof into two side portions which extend different distances along the length of said supporting rod so as to create different water resistances to said side portions of said impeller vane.

5. A boat impeller wheel as claimed in claim 1, wherein said supporting rods are mounted removably on said rotating shaft.

6. A boat impeller wheel as claimed in claim 1, wherein each of said impeller vanes is divided into two similar side portions by said tubular middle portion thereof.

7. A boat impeller wheel as claimed in claim 1, wherein said impeller vane has a center of gravity which is not on said axis of said supporting rod 8. A boat impeller wheel comprising a rotating shaft, and a plurality of impeller vane units, each of said impeller vane units including a supporting rod extending radially from said rotating shaft, a planar main plate secured to said supporting rod at an intermediate portion thereof in parallel with said rotating shaft and having a leading surface and a trailing surface, and a planar swing plate connected pivotally to a radial outer end of said trailing surface of said main plate at a radial outer end portion thereof and rotatable about an axis generally perpendicular to said supporting rod, whereby, when any one of said impeller vane units is turned downward from a substantially upward position to a substantially downward position about said rotating shaft, a radial inner end of said adjacent swing plate engages with said trailing surface of said main plate and when any one of said impeller vane units is turned upward away from an associated water's surface, said radial inner end of said adjacent swing plate is remote from said main plate.

9. A boat impeller wheel as claimed in claim 8, wherein each of said main plates has a cut-away portion opposite a major part of said corresponding swing plate so that splashes from said main plate are reduced.

10. A boat impeller wheel as claimed in claim 8, wherein said supporting rods are mounted removably on said rotating shaft.

11. A boat impeller wheel comprising a rotating shaft, and a plurality of impeller vane units, each of said impeller vane units including a cylindrical supporting rod having an axis and extending radially from said rotating shaft, a planar impeller vane having a circular and tubular middle portion which is sleeved rotatably on said supporting rod, and limiting means for limiting said impeller vane to rotate about said supporting rod between a first position and a second position, said impeller vane being almost parallel to said rotating shaft at said first position and generally perpendicular to said rotating shaft at said second position so that it can rotate about said supporting rod at an angle of no greater than 90°, said limiting means including a threaded hole formed in said supporting rod, a slide slot formed through a wall of said tubular middle portion of said impeller vane and extending in a circumferential direction on said tubular middle portion, and a bolt extending through said slide slot of said impeller vane to engage threadably with said threaded hole of said supporting rod, each of said impeller vanes including a buoyant element attached to a portion thereof other than said tubular middle portion so as to accelerate rotation of said impeller vane about said supporting rod, whereby, when any one of said impeller vanes is turned downward from a substantially forward position to a substantially downward position about said rotating shaft, it is almost parallel to the water surface and when any one of said impeller vanes is turned upward away from said water surface, it rotates rapidly about said supporting rod and until it is generally perpendicular to said water surface.

* * * * *